US006769667B2

(12) United States Patent
Kume et al.

(10) Patent No.: US 6,769,667 B2
(45) Date of Patent: Aug. 3, 2004

(54) CONTROL VALVE FOR VARIABLE-CAPACITY COMPRESSOR

(75) Inventors: Yoshiyuki Kume, Tokyo (JP); Toshiki Okii, Tokyo (JP); Masayuki Imai, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/301,842

(22) Filed: Nov. 22, 2002

(65) Prior Publication Data

US 2003/0102454 A1 Jun. 5, 2003

(30) Foreign Application Priority Data

Nov. 30, 2001 (JP) ..... 2001-367630
May 9, 2002 (JP) ..... 2002-134578

(51) Int. Cl.[7] ..... F04B 1/28; F16K 31/02
(52) U.S. Cl. ..... 251/129.18; 417/222.2
(58) Field of Search ..... 251/128.18; 417/222.2; 335/278

(56) References Cited

U.S. PATENT DOCUMENTS 4,780,059 A * 10/1988 Taguchi ..... 417/222.2
4,875,832 A * 10/1989 Suzuki et al. ..... 251/129.18 X
5,145,326 A * 9/1992 Kimura et al. ..... 417/222.2
5,890,876 A * 4/1999 Suito et al. ..... 417/222.2 X
5,992,822 A * 11/1999 Nakao et al. ..... 251/129.18 X
6,217,290 B1 * 4/2001 Imai et al. ..... 417/222.1
6,361,283 B1 * 3/2002 Ota et al. ..... 417/222.2
6,439,858 B1 * 8/2002 Kume et al. ..... 417/222.2
6,485,267 B1 * 11/2002 Imai et al. ..... 417/222.2

FOREIGN PATENT DOCUMENTS

EP 1091124 A2 * 4/2001 ..... F04B/27/18
EP 1106829 A2 * 6/2001 ..... F04B/27/18
JP 09-268973 10/1997

OTHER PUBLICATIONS

European Search Report.

* cited by examiner

*Primary Examiner*—Michael Mar
*Assistant Examiner*—Eric S. Keasel
(74) *Attorney, Agent, or Firm*—Rader, Fishamn & Grauer PLLC

(57) ABSTRACT

The sensitivity of a pressure-sensitive element in a pressure-sensitive part of a control valve for variable-capacity compressor is made adjustable by means of an adjusting screw provided so as to permit an adjustment of forward and backward movement with respect to a frame supporting the pressure-sensitive part. The adjusting screw is rotated by engaging an engagement part, which is annexed to a coil assembly constituting a solenoid excitation part, against the adjusting screw thereby to operate the coil assembly.

7 Claims, 9 Drawing Sheets

CONTROL VALVE FOR VARIABLE-CAPACITY COMPRESSOR

BACKGROUND OF THE INVENTION

1. Field of the Invention

The present invention relates to a control valve for variable-capacity compressor used in air conditioners of vehicles and the like and, more particularly, to a control valve for variable-capacity compressor controlling the supply of a coolant gas in the interior of a crankcase from a delivery-pressure region as required, which is characterized by means for adjusting and setting sensitivity in a pressure-sensitive part.

2. Description of the Related Art

Conventionally, variable-capacity compressors provided with a cylinder, a piston, a wobble plate, etc. have been used, for example, as disclosed in the Japanese Patent Application Laid-Open No. 9-268973, in compressing and delivering a coolant gas of an air conditioner for automobiles. A known variable-capacity compressor of the above-described type is provided with a coolant-gas passage that communicates with a delivery-pressure region and a crankcase, and configured so as to change the inclination angle of the wobble plate by adjusting the pressure in the interior of the above-described crankcase thereby to change delivery capacity. And for the pressure adjustment in the interior of the crankcase, there is provided means for supplying a high-pressure compressed coolant gas from the above-described delivery-pressure region to the above-described crankcase by the opening adjustment of a control valve provided within the coolant-gas passage.

And as the above-described control valve for variable-capacity compressor, there has been proposed a control valve in which for the adjustment of sensitivity in a pressure-sensitive part, means is provided to perform rotational operation by applying a tool (a screwdriver) to a screwdriver groove formed on the back portion of an adjusting screw (the Japanese Patent Application Serial No. 2001-108951). However, to adjust many control valves individually by use of tools requires not only tools separately, but also much labor and time, and there are cases where efficiency is low.

OBJECT AND SUMMARY OF THE INVENTION

An object of the invention is to ensure that the sensitivity adjustment of a pressure-sensitive part which constitutes a control valve for variable-capacity compressor is simply and easily performed and that, furthermore, in making a sensitivity adjustment, sealing after the sensitivity adjustment can be positively performed.

Therefore, in order to achieve the above-described object, a control valve for variable-capacity compressor in the first phase of the invention comprises a control valve body, a solenoid excitation part, and a pressure-sensitive part having a pressure-sensitive element, wherein the sensitivity of the pressure-sensitive element can be adjusted by an adjusting screw provided so as to permit an adjustment of forward and backward movement with respect to a frame supporting the pressure-sensitive part, and the adjusting screw is rotationally operated by engaging an engagement part, which is annexed to a coil assembly constituting the solenoid excitation part, against the adjusting screw thereby to operate the coil assembly.

The control valve of the first phase can have the following features.

A connector of the solenoid excitation part is formed integrally with the coil assembly by use of a synthetic resin.

A bellows is disposed as the pressure-sensitive element, the frame supporting the pressure-sensitive part is constituted by an attraction element, and the bellows is expanded and contracted by means of an adjusting screw provided so as to permit an adjustment of forward and backward movement with respect to this attraction element.

The bellows is expanded and contracted by rotating the coil assembly or connector with respect to the attraction element.

According to the control valve for variable-capacity compressor in the first phase of the invention, by rotating the coil assembly with respect to the attraction element, the adjusting screw is rotated and the bellows is expanded and contracted, with the result that the sensitivity of the pressure-sensitive element can be adjusted. Furthermore, because the connector is integrally formed with the coil assembly, the rotation of the adjusting screw becomes easy. In addition, because the sealing capacity of the coil portion is improved, a fear of corrosion decreases.

A control valve for variable-capacity compressor in the second phase of the invention comprises a control valve body, a solenoid excitation part, and a pressure-sensitive part having a pressure-sensitive element, wherein the sensitivity of the pressure-sensitive element can be adjusted by an adjusting screw provided so as to permit an adjustment of forward and backward movement with respect to a frame supporting the pressure-sensitive part, and the adjusting screw is rotationally operated by engaging an engagement part, which is annexed to a coil assembly constituting the solenoid excitation part, against the adjusting screw thereby to operate the coil assembly. Furthermore, a solenoid housing is provided at an outer periphery of the solenoid excitation part, and for mounting the above-described coil assembly on this solenoid housing through an O-ring, a ring-mounting recess with a notched section is formed in an outer periphery of this coil assembly, and the solenoid housing opposed to this ring-mounting recess is provided with a lid part which is formed in an end of the solenoid housing through a bending part.

The control valve of the second phase can have the following features.

A plurality of projections digging into the coil assembly are formed in an edge portion of the lid part.

The frame supporting the pressure-sensitive part is constituted by an attraction element, and the bellows is expanded and contracted by means of an adjusting screw provided so as to permit an adjustment of forward and backward movement with respect to this attraction element.

The bellows is expanded and contracted by rotating the coil assembly or connector with respect to the attraction element.

According to the control valve for variable-capacity compressor in the second phase of the invention, by rotating the coil assembly with respect to the attraction element, the adjusting screw is rotated and the bellows is expanded and contracted, with the result that the sensitivity of the pressure-sensitive element can be adjusted. Furthermore, because the connector is integrally formed with the coil assembly and rotational operation can be preformed without giving a rotational force to the O-ring, the rotation of the adjusting screw becomes easy. In addition, because no irregularity occurs in the seal ring, the sealing capacity of the coil portion is improved and a fear of corrosion decreases.

DETAILED DESCRIPTION OF THE PREFERRED EMBODIMENTS

Before the description of the embodiments of a control valve for variable-capacity compressor of the invention, the variable-capacity compressor (FIGS. 1 and 2) described in the U.S. application Ser. No. 10/109661 and the first example (FIGS. 3 and 4) and the second example (FIG. 5) of a control valve used in this compressor will be first described by referring to FIGS. 1 to 5.

Figure 1:
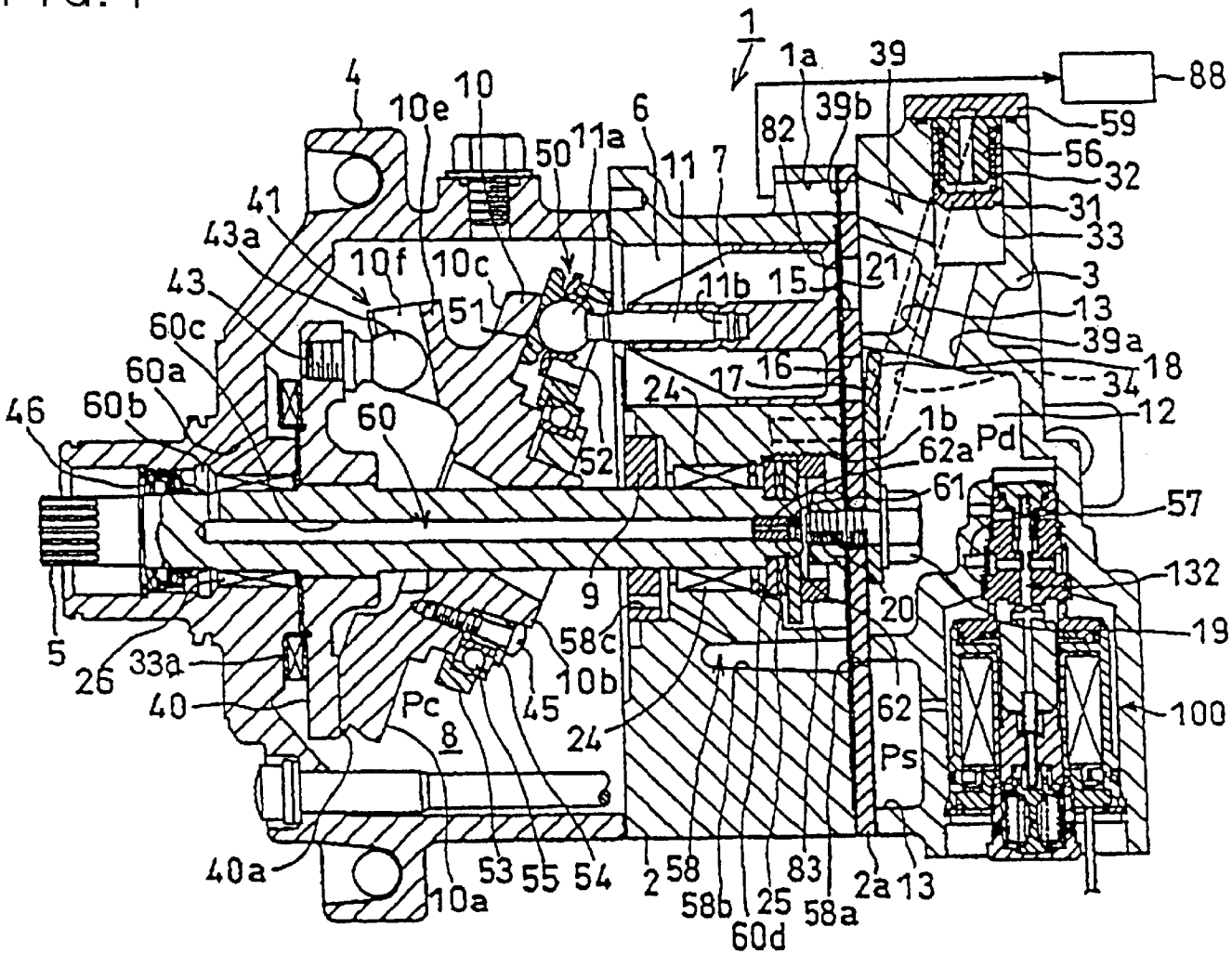
FIG. 1 is a longitudinal sectional view of a variable-capacity compressor, whose delivery passage is in an open condition.
Figure 2:
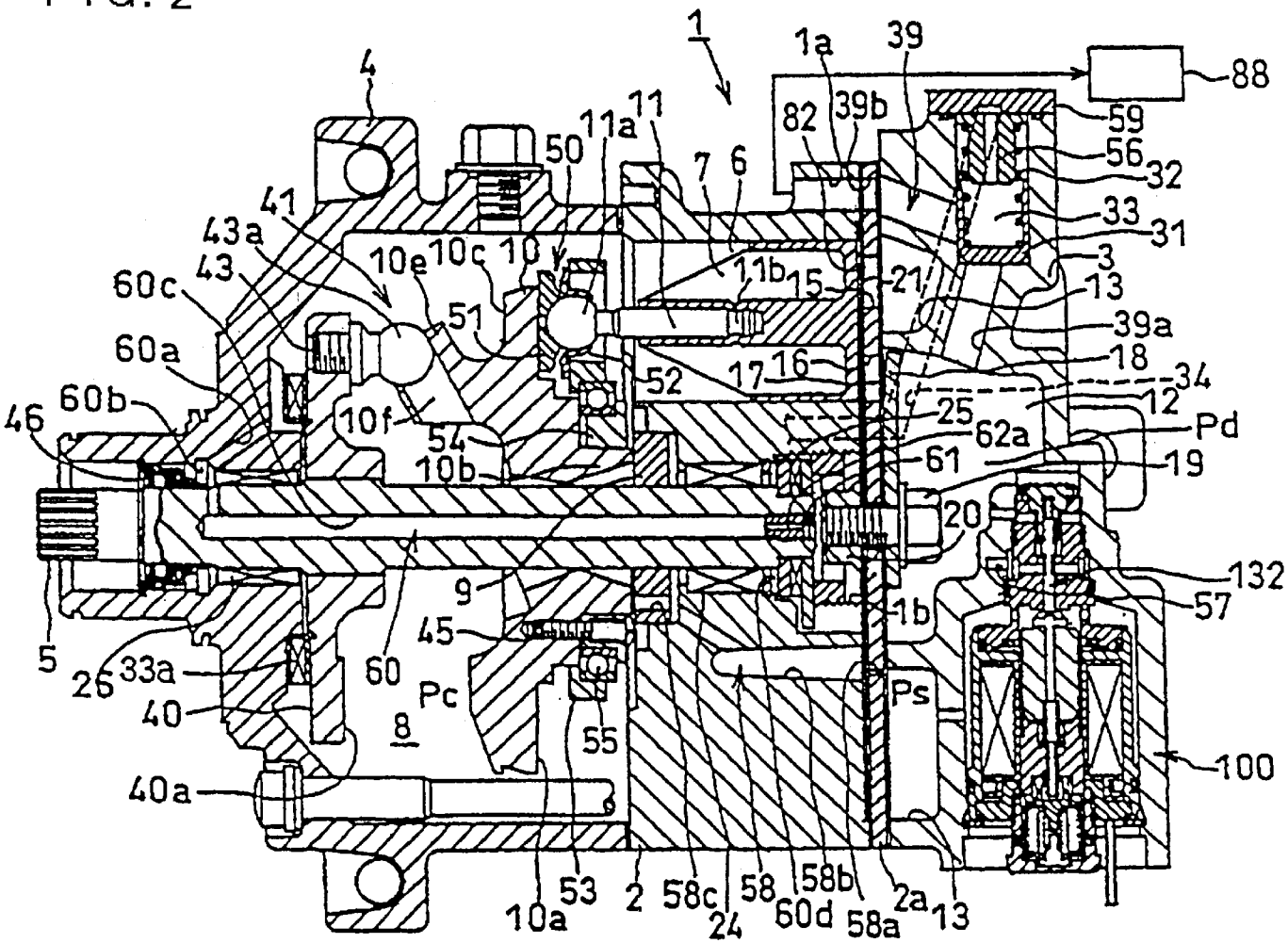
FIG. 2 is a longitudinal sectional view of the variable-capacity compressor of FIG. 1, whose delivery passage is in a closed condition.
Figure 3:
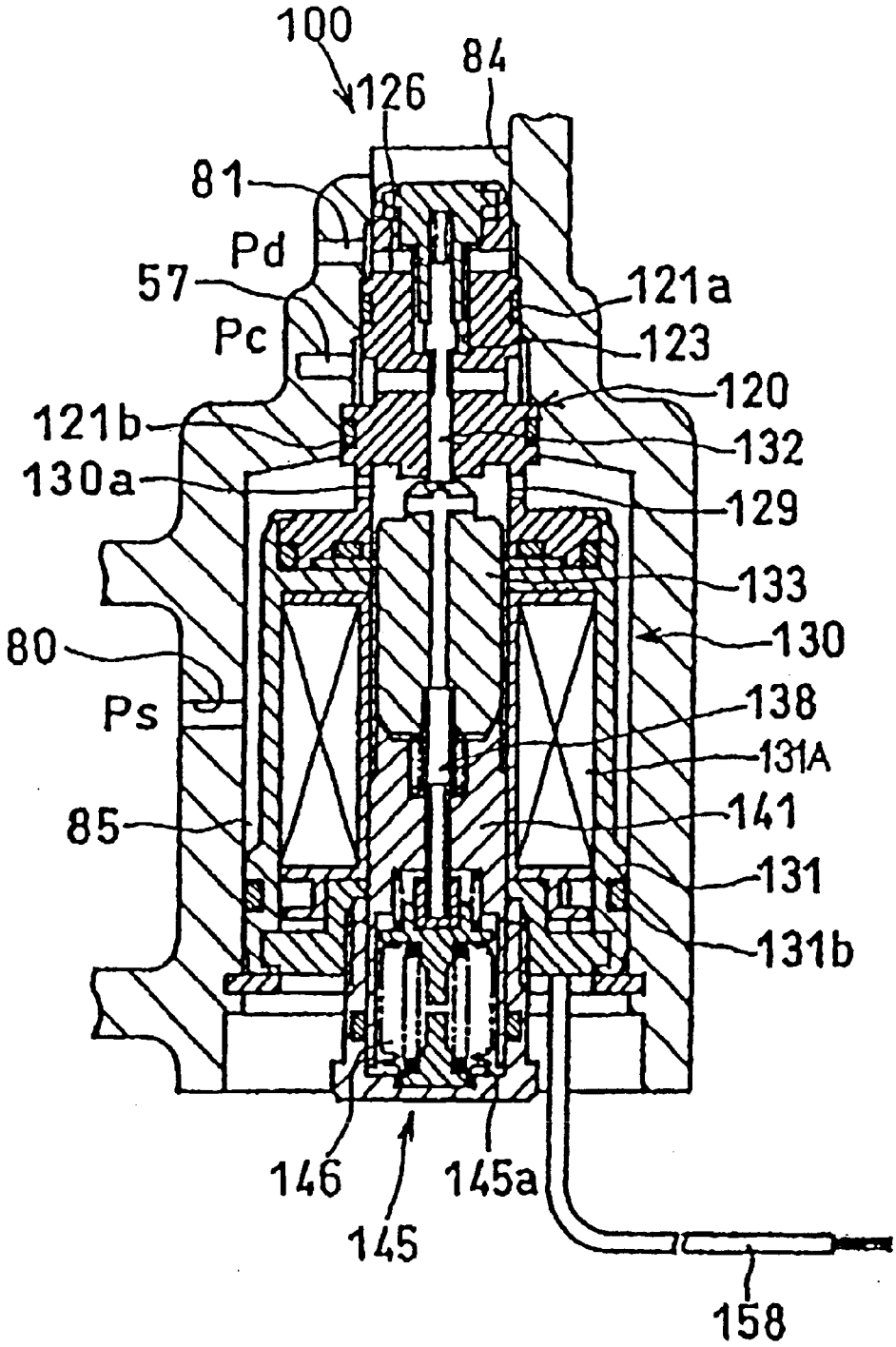
FIG. 3 is an enlarged longitudinal sectional view of a control valve used in the variable-capacity compressor of FIG. 1.
Figure 4:
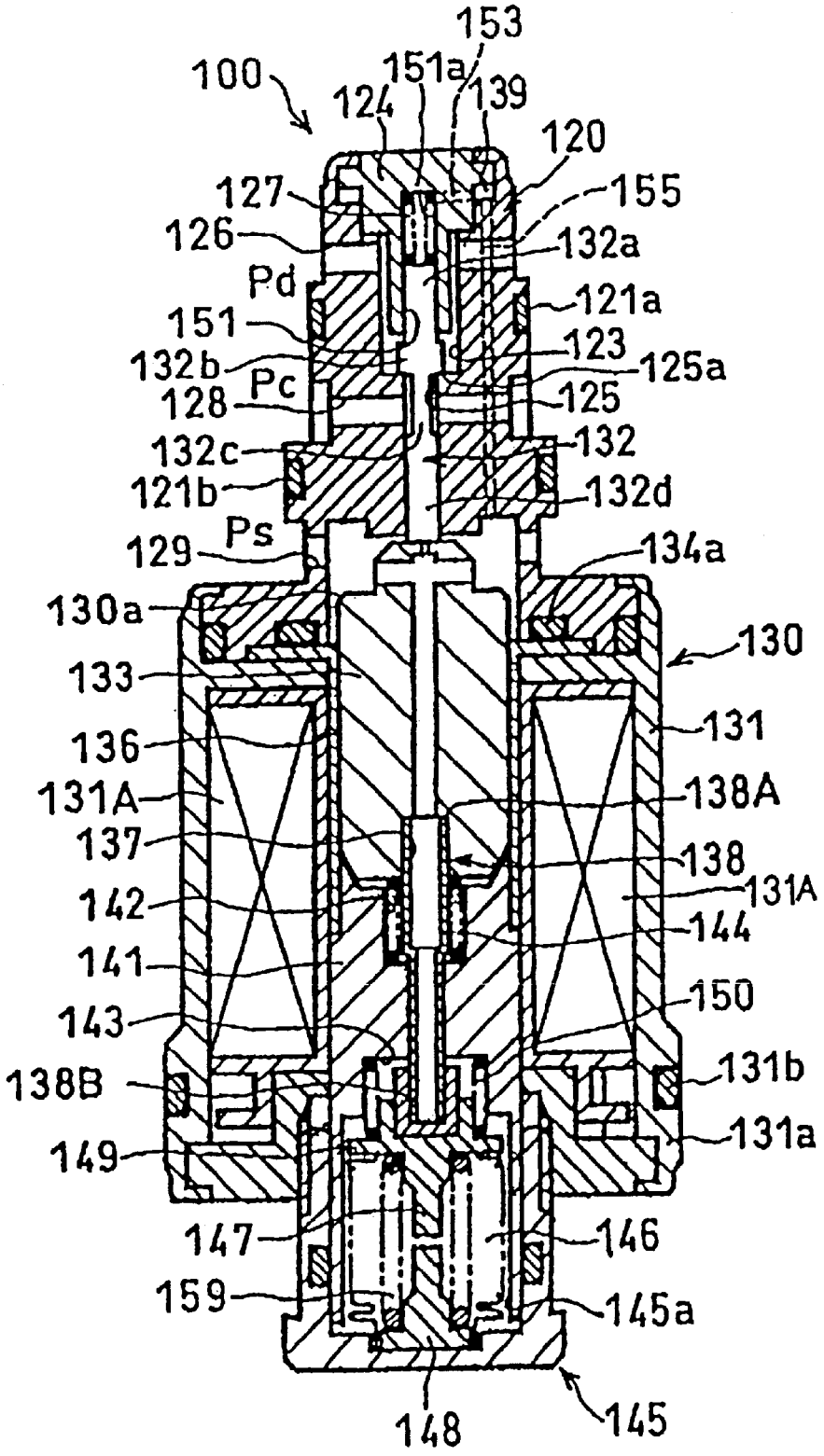
FIG. 4 is an enlarged longitudinal sectional view of the details of the control valve of FIG. 3.

First, the variable-capacity compressor will be described by referring to FIGS. 1 and 2. In this variable-capacity compressor, the control valve shown in FIGS. 3 and 4 is used. A detailed construction of this control valve will be described later. FIG. 1 is a longitudinal sectional view of this variable-capacity compressor 1, whose delivery passage is in an open condition, and FIG. 2 is a longitudinal sectional view of this variable-capacity compressor, whose delivery passage is in a closed condition.

A rear housing 3 is fixed to one end surface of a cylinder block 2 of a variable-capacity compressor 1 via a valve plate 2*a*, and a front housing 4 is fixed to the other end surface thereof. In the cylinder block 2, a plurality of cylinder bores 6 are disposed around a shaft 5 at equal intervals in a circumferential direction. A piston 7 is slidably housed in each cylinder bore 6.

A crankcase 8 is formed in the front housing 4. A wobble plate 10 is disposed in the crankcase 8. On a sliding surface 10*a* of the wobble plate 10, a shoe 50, that supports one spherical end 11*a* of a connecting rod 11 such that the spherical end 11*a* can slide relative to the shoe 50, is held by a retainer 53. The retainer 53 is mounted to a boss 10*b* of the wobble plate 10 via a radial bearing 55 such that the retainer 53 can rotate relative to the wobble plate 10.

The radial bearing 55 is locked to the boss 10*b* by means of a stopper 54 fixed by a screw 45. The other end 11*b* of the connecting rod 11 is fixed to the piston 7.

The shoe 50 is composed of a shoe body 51 which supports the leading end surface of one end 11*a* of the connecting rod 11 such that the one end 11*a* can roll relative to the shoe 50, and a washer 52 which supports the trailing end surface 11*a* of the connecting rod 11 such that the trailing end surface 11*a* can roll relative to the washer 52.

A discharge chamber 12 and a suction chamber 13 are formed in the rear housing 3. The suction chamber 13 is arranged so as to surround the discharge chamber 12. A suction port (not shown) that communicates with an evaporator (not shown) is provided in the rear housing 3. FIG. 1 shows a discharge passage 39 in an open state and FIG. 2 shows the discharge passage 39 in a closed state.

Midway in the discharge passage 39 that provides communication between the discharge chamber 12 and a discharge port 1*a*, there is provided a spool valve (a discharge control valve) 31. The discharge passage 39 is composed of a passage 39*a* formed in the rear housing and a passage 39*b* formed in the valve plate 2*a*. The passage 39*b* communicates with the discharge port 1*a* formed in the cylinder block 2.

A spring (an urging member) 32 is disposed within the cylindrical spool valve 31 having a bottom. One end of this spring 32 abuts against a stopper 56 fixed to the rear housing 3 by means of a cap 59. The other end of the spring 32 abuts against the bottom surface of the spool valve 31. The inner space 33 of the spool valve 31 communicates with the crankcase 8 via a passage 34.

On one side (the upper side) of the spool valve 31 the urging force of the spring 32 and the pressure of the crankcase 8 act in a direction in which the urging force and pressure close the spool valve 31 (in a direction in which the urging force and pressure reduce the opening of the valve 31). On the other hand, when the spool valve 31 is open as shown in FIG. 1, the discharge port 1*a* and the discharge chamber 12 communicate with each other via the discharge passage 39 and, therefore, on the other side (the lower side) of the spool valve 31 the pressure of the discharge port 1*a* and the pressure of the discharge chamber 12 act in a direction in which both pressures open the spool valve 31 (in a direction in which both pressures increase the opening of the valve 31).

However, when a pressure difference between the crankcase 8 and the discharge port 1*a* becomes not more than a prescribed value, the spool valves 31 moves in a closing direction and blocks the discharge passage 39. As a result, on the lower side of the spool valve 31, the pressure of the discharge port 1*a* ceases to act and only the pressure of the discharge chamber 12 acts in a direction in which the pressure opens the valve 31.

The discharge chamber 12 and the crankcase 8 communicate with each other via a second passage 57. Midway in this second passage 57, a control valve 100 shown in FIGS. 3 and 4, which will be described in detail later, is disposed at a position lower than the center position of the compressor 1. In the case of a large thermal load, this second passage 57 is blocked because a valve element 132 is placed on a valve seat due to the energization of the solenoid 131A (FIG. 3) of the control valve 100. On the other hand, in the case of a small thermal load, the second passage 57 communicates because the valve element 132 leaves a valve seat 125*a* (FIG. 4) due to the stop of the energization of the solenoid 131A. The operation of the control valve 100 is controlled by a computer (not shown).

The suction chamber 13 and the crankcase 8 communicate with each other via a first passage 58. This first passage 58 is composed of an orifice (a second orifice) 58*a* formed in the valve plate 2*a*, a passage 58*b* formed in the cylinder block 2, and a hole 58*c* formed in a ring (an annular part) 9 fixed to the shaft 5. The suction chamber 13 and the crankcase 8 communicate with each other via a third passage 60.

This third passage 60 is composed of a passage 60*a* formed in the front housing 4, a front-side bearing-housing space 60*b*, a passage 60*c* formed in the shaft 5, a rear-side bearing-housing space 60*d* formed in the cylinder block 2, the passage 58*b* of cylinder block 2, and an orifice 58*a* of valve plate 2*a*.

Therefore, the passage 58*b* of cylinder block 2 and the orifice 58*a* of valve plate 2*a* constitute part of the first passage 58 and, at the same time, constitute also part of the third passage 60.

A female thread 61 is formed on the inner peripheral surface of the rear-side end of the passage 60*c* formed in the shaft 5. A screw 62 is screwed into this female thread 61. An orifice (a first orifice) 62*a* is formed in this screw 62, and the passage area of this orifice 62*a* is smaller than the passage area of the second orifice 58*a* in the valve plate 2*a* that constitutes part of the first passage 58.

Therefore, only in a case where the boss 10*b* of wobble plate 10 almost blocks the hole 58*c* of ring 9 and the passage area of the first passage 58 has decreased greatly, the coolant in the crankcase 8 is introduced into the suction chamber 13 via the third passage 60.

In the valve plate 2*a*, there are provided a plurality of discharge ports 16, which provide communication between a compression chamber 82 and the discharge chamber 12, and a plurality of suction ports 15, which provide communication between the compression chamber 82 and the suction chamber 13, respectively, at equal intervals in the circumferential direction. The discharge port 16 is opened and closed by a discharge valve 17. The discharge port 17, along with a valve-holding member 18, is fixed to the side end surface of the rear housing of valve plate 2*a* by means of a bolt 19 and a nut 20. On the other hand, the suction port 15 is opened and closed by a suction valve 21. This suction valve 21 is disposed between the valve plate 2*a* and the cylinder block 2.

The rear-side end of the shaft 5 is rotatably supported by a radial bearing (a rear-side bearing) 24 housed in the rear-side bearing-housing space 60*d* of cylinder block 2 and a thrust bearing (a rear-side bearing) 25. On the other hand, the front-side end of the shaft 5 is rotatably supported by a radial bearing (a front-side bearing) 26 housed in the front-side bearing-housing space 60*b* of front housing 4. A shaft seal 46, in addition to the radial bearing 26, is housed in the front-side bearing-housing space 60*b*.

A female thread 1*b* is formed in the middle of the cylinder block 2. An adjusting nut 83 engages on this female thread 1*b*. A preload is given to the shaft 5 via the thrust bearing by tightening this adjusting nut 83. Furthermore, a pulley (not shown) is fixed to the front-side end of the shaft 5.

A thrust flange 40 that transmits the rotation of the shaft 5 to the wobble plate 10 is fixed to the shaft 5. This thrust flange 40 is supported by the inner wall surface of the front housing via a thrust bearing 33*a*. The thrust flange 40 and the wobble plate 10 are connected to each other via a hinge mechanism 41. The wobble plate 10 is mounted on the shaft 5 so that the wobble plate 10 can slide on the shaft 5 and can, at the same time, incline with respect to a virtual surface at right angles to the shaft 5.

The hinge mechanism 41 is composed of a bracket 10*e* provided on a front surface 10*c* of wobble plate 10, a linear guide groove 10*f* provided in this bracket 10*e*, and a rod 43 screw-threaded onto a wobble plate-side side surface 40*a* of the thrust flange 40. The longitudinal axis of the guide groove 10*f* is inclined to the front surface 10*c* of wobble plate 10 at a prescribed angle. A spherical portion 43*a* of the rod 43 is slidably fitted into the guide groove 10*f*.

Next, a first example of the control valve 100 used in a variable-capacity compressor 1 shown in FIGS. 1 and 2 will be explained in detail by referring to FIGS. 3 and 4. FIG. 3 is an enlarged longitudinal sectional view of a control valve 100 incorporated into a variable-capacity compressor 1 and FIG. 4 is a longitudinal sectional view of the details of the control valve shown in FIG. 3.

The control valve 100 is disposed in the spaces 84, 85 of the rear housing 3 of the variable-capacity compressor 1 shown in FIGS. 1 and 2 with an airtight state maintained via O-rings 121*a*, 121*b*, 131*b*.

As shown in FIG. 4, the control valve 100 is composed of a control valve body 120, a solenoid excitation part 130, and a pressure-sensitive part 145. The solenoid excitation part 130 is disposed in the middle, the control valve body 120 is disposed on the upper side of the solenoid excitation part 130, and the pressure-sensitive part 145 is disposed on the lower side of the solenoid excitation part 130.

The solenoid excitation part 130 is provided with a solenoid housing 131 along the periphery thereof. In the interior of this solenoid housing 131, a solenoid 131A, a plunger 133 that moves vertically by the excitation of the solenoid 131A, an attraction element 141, and a stem 138 are disposed. A plunger chamber 130*a* that houses the plunger 133 communicates with a suction coolant port 129 provided in the control valve body 120.

The pressure-sensitive part 145 is arranged on the lower side of the solenoid housing 131. In a pressure-sensitive chamber 145*a* formed in this pressure-sensitive part 145, a bellows 146 and a spring 159 that operate the plunger 133 via the stem 138, etc are disposed.

The control valve body 120 is provided with a valve chamber 123. In this valve chamber 123, a valve element 132 that performs opening and closing operations by the plunger 133 is disposed. A coolant gas at a high discharge pressure Pd flows into this valve chamber 123 via a passage 81 and a discharge coolant port 126. On the bottom surface of the valve chamber 123, a valve hole 125 that communicates with a crankcase coolant port 128 is formed. The space in the upper part of the valve chamber 123 is blocked by a stopper 124. In the center part of this stopper 124, a pressure chamber 151 opposite to the valve hole 125 is formed. This pressure chamber 151 is a bottomed pit having the same sectional area with the valve hole 125. This pressure chamber 151, which is a bottomed pit, functions also as a spring-housing chamber 151*a* and, on the bottom thereof, a valve-closing spring 127 for urging the valve element 132 toward the bottom of the valve chamber 123 is disposed.

The valve element 132 is composed of an upper portion 132*a*, an enlarged valve element portion 132*b*, a small-diameter portion 132*c*, and a lower portion 132*d*. The valve element 132 takes on the shape of a bar as a whole and the upper portion 132*a* and lower portion 132*d* thereof have a sectional area equal to that of the valve hole 125. The upper portion 132*a* is fitted onto and supported by the stopper 124 having the pressure chamber 151. The enlarged valve element portion 132*b* is arranged in the valve chamber 123. Within the valve hole 125, the small-diameter portion 132*c* is opposed to a crankcase coolant port 128 that communicates with the crankcase (crankcase pressure Pc). The lower portion 132*d* is fitted onto and supported by the interior of the control valve body 120, and the lower end thereof is inserted into the plunger chamber 130*a*, into which a coolant gas at the suction pressure Ps is introduced, and is in contact with the plunger 133. For this reason, when the plunger 133 moves up and down, the valve element 132 moves up and down, whereby a gap between the enlarged valve element portion 132*b* of valve element 132 and a valve seat 125*a* formed in the upper surface of the valve hole 125 is adjusted.

And the suction pressure Ps at a low temperature that flows into the plunger chamber 130*a* is introduced into the pressure-sensitive part 145, which will be described later, and at the same time this suction pressure Ps is also introduced into a suction-pressure introduction space 85 between the rear housing 3 and a solenoid housing 131 (FIG. 3). This suction-pressure introduction space 85 is sealed by an O-ring 131*b* provided on a projection 131*a* formed on the side of the solenoid housing 131, whereby the cooling of the whole side of the solenoid housing 131 is accomplished by a low-temperature coolant gas from the suction chamber 13.

In the interior of the solenoid housing 131, which is caulked and connected to the control valve body 120, the plunger 133 that contact-fixes the valve element 132 as shown in FIG. 4 is disposed. This plunger 133 is slidably housed in a pipe 136 attached to an end of the control valve body 120 via an O-ring 134*a*.

A stem 138 is fixed to the plunger 133, with the upper portion 138A thereof being inserted in a housing hole 137 formed at the lower end of the plunger 133. On the other hand, the lower portion 138B of the stem 138, which passes through an upper-end-housing hole 142 of the attraction element 141 and protrudes from the side of a lower-end-housing hole 143, can slide with respect to the attraction element 141. Between the plunger 133 and the upper-end-housing hole 142 of the attraction element 141, there is provided a valve-opening spring 144 that urges in a direction in which the valve-opening spring 144 detaches the plunger 133 from the side of the attraction element 141.

Also, the stem 138 is arranged in such a manner that the lower portion 138B thereof can come into contact with or leave a first stopper 147 within the bellows 146 disposed in a pressure-sensitive chamber 145*a*. Within the bellows 146, a second stopper 148, in addition to this first stopper 147, is provided. Between a flange 149 of the first stopper 147 and the lower-end-housing hole 143 of the attraction element 141, there is provided a spring 150 that urges in a direction in which the spring 150 detaches the first stopper 147 from the side of the attraction element 141.

When the suction pressure Ps in the pressure-sensitive chamber 145*a* increases, the bellows 146 contracts and the first stopper 147 comes into contact with the second stopper 148. At this point of time, the displacement of the bellows 146 is controlled. The maximum amount of displacement of this bellows 146 is set so that it becomes smaller than the maximum amount of fit between the lower portion 138B of stem 138 and the first stopper 147 of bellows 146.

Incidentally, a cord 158 capable of feeding a solenoid current that is controlled by a control computer (not shown) is connected to the solenoid 131A (FIG. 3).

Also, the stopper 124 that blocks the valve chamber 123 is provided with a transverse hole 153 that communicates with the pressure chamber 151, as shown in FIG. 4. This transverse hole 153 provides communication between a gap 139 formed by the stopper 124 and control valve body 120 and the pressure chamber 151. On the other hand, a cancel hole 155 that provides communication between the gap 139 and the plunger chamber 130*a* into which a coolant gas at the suction pressure Ps flows is formed in the control valve body 120.

Next, the operation of the variable-capacity compressor 1 shown in FIGS. 1 and 2 and the operation of the control valve 100 incorporated into the variable-capacity compressor 1, shown in FIGS. 3 and 4, will be described below.

The rotary power of a car-mounted engine is transmitted to the shaft 5 from a pulley (not shown) via a belt (not shown). The rotary power of the shaft 5 is transmitted to the wobble plate 10 via the thrust flange 40 and hinge mechanism 41 thereby to rotate the wobble plate 10.

By the rotation of the wobble plate 10, the shoe 50 performs relative rotation on the sliding surface 10*a* of the wobble plate 10. As a result, the piston 7 performs linear reciprocating motions and changes the volume of the compression chamber 82 in the cylinder bore 6. According to this volume change of the compression chamber 82 the suction, compression and discharge processes of a coolant gas are sequentially performed and the coolant gas of a volume corresponding to the inclination angle of the wobble plate 10 is delivered.

First, in the case of a large thermal load, the flow of the coolant gas from the discharge chamber 12 to the crankcase 8 is blocked and, therefore, the pressure of crankcase 8 drops and a force generated on the rear surface of the piston 7 during the compression process decreases. For this reason, the sum total of forces generated on the rear surface of the piston 7 drops below the sum total of forces generated on the front surface (top surface) of the piston 7. As a result, the inclination angle of the wobble plate 10 increases.

When the pressure of discharge chamber 12 rises and the pressure difference between the discharge chamber 12 and the crankcase 8 becomes not less than a specified value, with the result that the pressure of the coolant gas in the discharge chamber 12 acting on the lower side of the spool valve 31 exceeds the sum total of the pressure of the coolant gas in the crankcase 8 acting on the upper side of the spool valve 31 and the urging force of the spring 32, then the spool valve 31 moves in an opening direction and the discharge passage 39 opens (FIG. 1), as a result of which the coolant gas in the discharge chamber 12 flows out of the discharge port 1*a* into a capacitor 88.

Incidentally, when the inclination angle of the wobble plate 10 changes from a minimum to a maximum, the boss 10*b* of the wobble plate 10 leaves the hole 58*c* of the ring 9 and the first passage 58 is fully opened, with the result that the coolant gas in the crankcase 8 flows into the suction chamber via the first passage 58. For this reason, the pressure of the crankcase 8 drops.

Furthermore, when the passage area of the first passage 58 becomes a maximum, the coolant gas scarcely flows from the third passage 60 into the suction chamber 13.

When in this manner the thermal load increases and the solenoid 131A of the control valve 100 is excited, the plunger 133 is attracted toward the attraction element 141 and the valve element 132 with which the plunger 133 is in contact moves in a direction in which the valve element 132 closes the valve opening, whereby the flow of the coolant gas into the crankcase 8 is blocked.

On the other hand, the low-temperature coolant gas is introduced into the pressure-sensitive part 145 from the side of the passage 80 (FIG. 3) that communicates with the suction chamber 13 via the suction coolant port 129 of the control valve body 120 and the plunger chamber 130*a*. As a result, the bellows 146 of the pressure-sensitive part 145 displaces on the basis of the coolant gas pressure that is the suction pressure Ps of the suction chamber 13. The displacement of this bellows 146 is transmitted to the valve element 132 via the stem 138 and plunger 133.

That is, the opening of the valve hole 125 by the valve element 132 is determined by the attractive force of the solenoid 131A, the urging force of the bellows 146 and the urging force of the valve-closing spring 127 and of the valve-opening spring 144.

And when the pressure in the pressure-sensitive chamber 145*a* (the suction pressure Ps) increases, the bellows 146 contracts and the movement of the valve element 132 responds to this displacement of the bellows 146 (the direction of displacement of the valve element 132 corresponds to the direction of attraction of the plunger 133 by the solenoid 131A), whereby the opening of the valve hole 125 is reduced. As a result, the volume of the high-pressure coolant gas introduced from the discharge chamber 12 into the valve chamber 123 decreases (the crankcase pressure Pc drops) and the inclination angle of the wobble plate 10 increases (FIG. 1).

Also, when the pressure in the pressure-sensitive chamber 145*a* drops, the bellows 146 is expanded by the restoring force of the spring 159 and the bellows 146 itself and the valve element 132 moves in a direction in which the valve element 132 increases the opening of the valve hole 125. As a result, the volume of the high-pressure coolant gas introduced into the valve chamber 123 increases (the crankcase pressure Pc increases) and the inclination angle of the wobble plate 10 in the state shown in FIG. 1 decreases.

In contrast to this, when the thermal load is small, the high-pressure coolant gas flows from the discharge chamber 12 into the crankcase 8, thereby raising the pressure of the crankcase 8. As a result, a force generated on the rear surface of the piston 7 during the compression process increases and the sum total of forces generated on the rear surface of the piston 7 exceeds the sum total of forces generated on the front surface of the piston 7, thereby reducing the inclination angle of the wobble plate 10.

When the pressure difference between the discharge chamber 12 and the crankcase 8 becomes not more than a specified value and the sum total of the pressure of the crankcase 8 acting on the upper side of the spool valve 31 and the urging force of the spring 32 exceeds the pressure of the coolant gas in the discharge chamber 12 acting on the lower side of the spool valve 31, then the spool valve 31 moves in a closing direction and blocks the discharge passage 39 (FIG. 2), thereby blocking the outflow of the coolant gas from the discharge port 1*a* into the capacitor 88.

Incidentally, when the inclination angle of the wobble plate 10 becomes a minimum from a maximum, the boss 10*b* of the wobble plate 10 almost blocks the hole 58*c* of the ring 9 and substantially reduces the passage sectional area of the first passage 58. However, because the coolant gas in the crankcase 8 flows out toward the suction chamber 13 via the third passage 60, an excessive pressure increase in the crankcase 8 is suppressed and it becomes possible for the coolant gas in the compressor 1 to circulate.

That is, the coolant gas flows through the suction chamber 13, compression chamber 82, discharge chamber 12, second passage 57, crankcase 8 and third passage 60, and returns to the suction chamber 13 again.

In the variable-capacity compressor 1 shown in FIGS. 1 and 2, the structure is such that the pressure of crankcase 8 is caused to act on one side of the spool valve 31 that functions as the discharge control valve, while the pressure of discharge chamber 12 is caused to act on the other side, and the spring 32 having a relatively small spring force is used to urge the spool valve 31 in a direction in which the spring 32 closes the spool valve 31. Therefore, when the thermal load decreases and the pressure of discharge chamber 12 drops gradually, the stroke of the piston 7 becomes a minimum (an extra-small load) and the spool valve 31 maintains an open state until the wobble plate 10 reduces the passage area of the first passage 58.

When in this manner the thermal load decreases and the solenoid 131A is demagnetized, the attractive force to the plunger 133 disappears, with the result that the plunger 133 moves in a direction in which the plunger 133 leaves the attraction element 141 due to the urging force of the valve-opening spring 144 and the valve element 132 moves in a direction in which the valve element 132 opens the valve hole 125 of the control valve body 120, whereby the inflow of the coolant gas into the crankcase 8 is promoted.

When the pressure in the pressure-sensitive part 145 rises, the bellows 146 contracts and the opening of the valve element 132 decreases. However, because the lower portion 138B of the stem 138 can come close to and away from the first stopper 147 of the bellows 146, the displacement of the bellows 146 will not have an effect on the valve element 132.

As described above, the control valve 100 shown in FIGS. 3 and 4 is constituted by the solenoid excitation part 130, which is provided, at the middle thereof, with the plunger 133 moving vertically by the excitation of the solenoid 131A, the pressure-sensitive part 145, in which the bellows 146 operating synchronously with the plunger 133 via the stem 138, etc. is disposed on the lower side of the solenoid excitation part 130, and the control valve body 120 that has the valve chamber 123 in which the valve element 132 operating synchronously with the plunger 133, etc., are disposed on the upper side of the solenoid housing 131. Therefore, because the pressure-sensitive chamber 145*a* and the solenoid 131A are disposed in close vicinity to each other, the point of application by the attraction of the solenoid 131A and the point of application by the bellows 146 approach each other, with the result that when the valve element 132 and stem 138 move simultaneously in a closing direction, the occurrence of backlash between them is minimized as far as possible.

Next, a second example of a control valve 100 for variable-capacity compressors 1 will be described below by referring to FIG. 5. This control valve 100 has features mainly in the structure of an attraction element and a pressure-sensitive part.

An attraction element 141 of the control valve 100 is constituted by a cylindrical portion 141*b* engaged on the inside of a solenoid excitation part 130, a cover portion 141*c* press-fitted at the upper end of the cylindrical portion 141*b*, and an adjusting screw 157 engaged on the lower side of the cylindrical portion 141*b*. A pressure-sensitive part 145 is provided in the inside of the cylindrical portion 141*b*.

The cylindrical portion 141*b* of the attraction element 141 is, from the lower side thereof, engaged to the adjusting screw 157 and, on the other hand, from the upper side thereof, a stopper 148, a spring 159, a bellows 146 and a flange 149 of the stopper 148, and a spring 150 are installed. At the upper end of the cylindrical portion 141*b*, a cover portion 141*c* is press-fitted. And a joint between the cylindrical portion 141*b* and the cover portion 141*c* is TIG welded and a pressure-sensitive chamber 145*a* is formed inside the attraction element 141. For this reason, compact design can be ensured by the shortening in the longitudinal axial direction of the control valve 100. Incidentally, the adjusting screw 157 is intended for use in the adjustment of the displacement of the bellows 146 by the adjustment of the position of the stopper 148 from the outside.

A plunger 133 is provided with a coolant vent 133*f* in the interior thereof in the longitudinal direction and is also provided with a slit 133*a* for introducing the coolant at the suction pressure Ps into the pressure-sensitive part 145 in the outer surface thereof in the longitudinal direction. Furthermore, a stem 140 having an almost half-moon section is used in the control valve 100 according to the second example. Therefore, the coolant gas at the suction pressure Ps in the plunger chamber 130*a* is introduced into the pressure-sensitive part 145 via the slit 133*a* of plunger 133 and the stem 140.

Furthermore, the control valve body 120 and the solenoid excitation part 130 used in the control valve 100 according to the second example are, unlike those of the first example of control valve 100 shown in FIGS. 3 and 4, connected together via a pipe 136 and a spacer, by performing caulking from the side of the control valve body 120. Incidentally, a gap between the control valve body 120 and the solenoid excitation part 130 is sealed by means of packing 134*b*.

Figure 5:
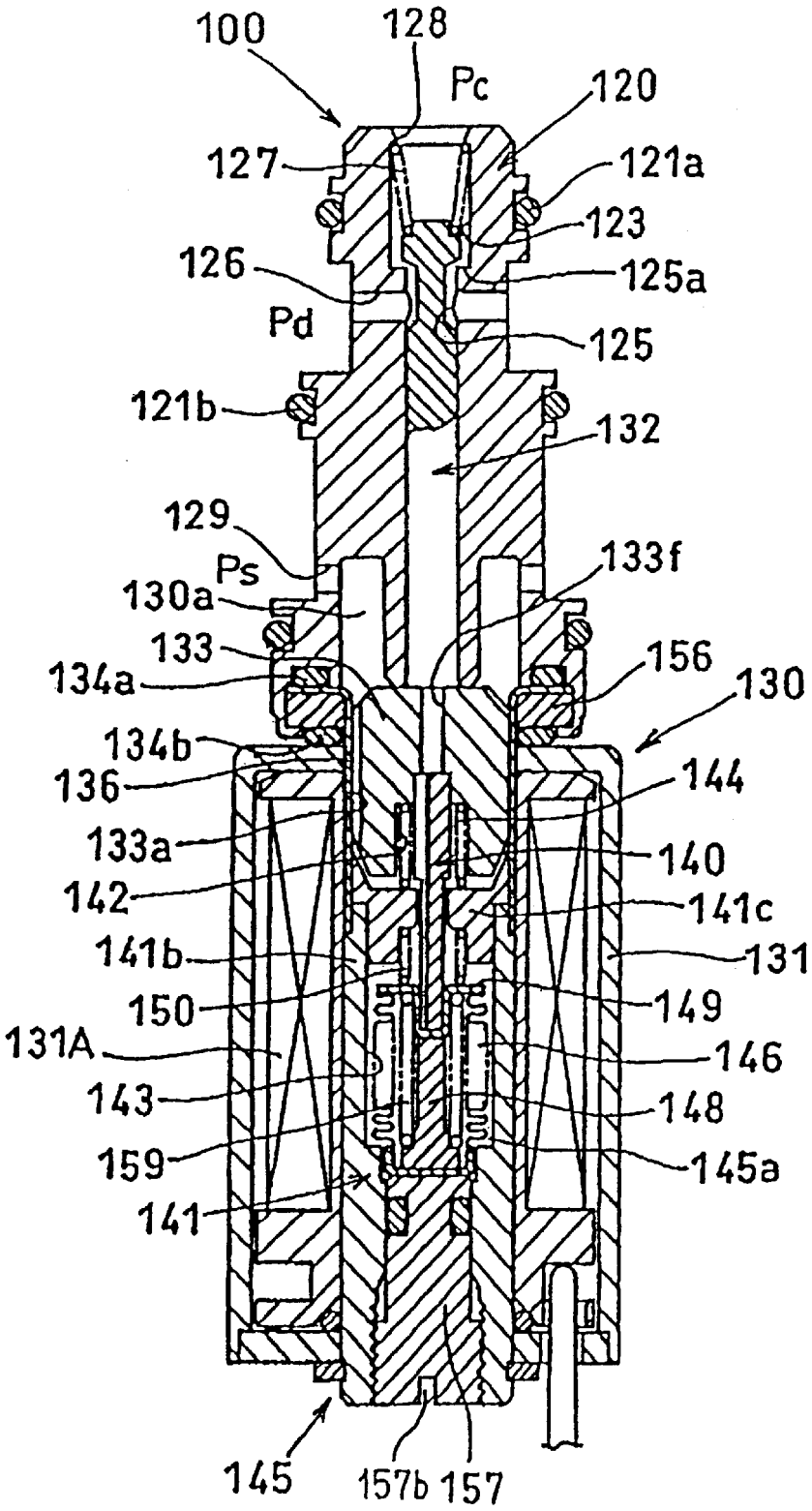
FIG. 5 is an enlarged longitudinal sectional view of a control valve in another example different from the control valve of FIG. 3.

Incidentally, in a control valve 100 shown in FIG. 5, for the adjustment of sensitivity in a pressure-sensitive part, rotational operation is performed by applying a tool (a screwdriver) to a screwdriver groove 157*b* formed in an adjusting screw 157. However, according to the above-described means, to adjust many control valves individually by use of tools requires not only tools separately, but also much labor and time, and there are cases where efficiency is low.

Therefore, in order to simplify and facilitate the sensitivity adjustment of the pressure-sensitive part constituting the control valve, control valves in the first and second embodiments of the invention are provided.

First, the control valve in the first embodiment of the invention will be described by referring to FIGS. 6A and 6B and FIGS. 7A to 7C. Incidentally, the same reference numerals shown in FIGS. 6A and 6B as those shown in FIG. 5 denote the same members.

Figure 6A:
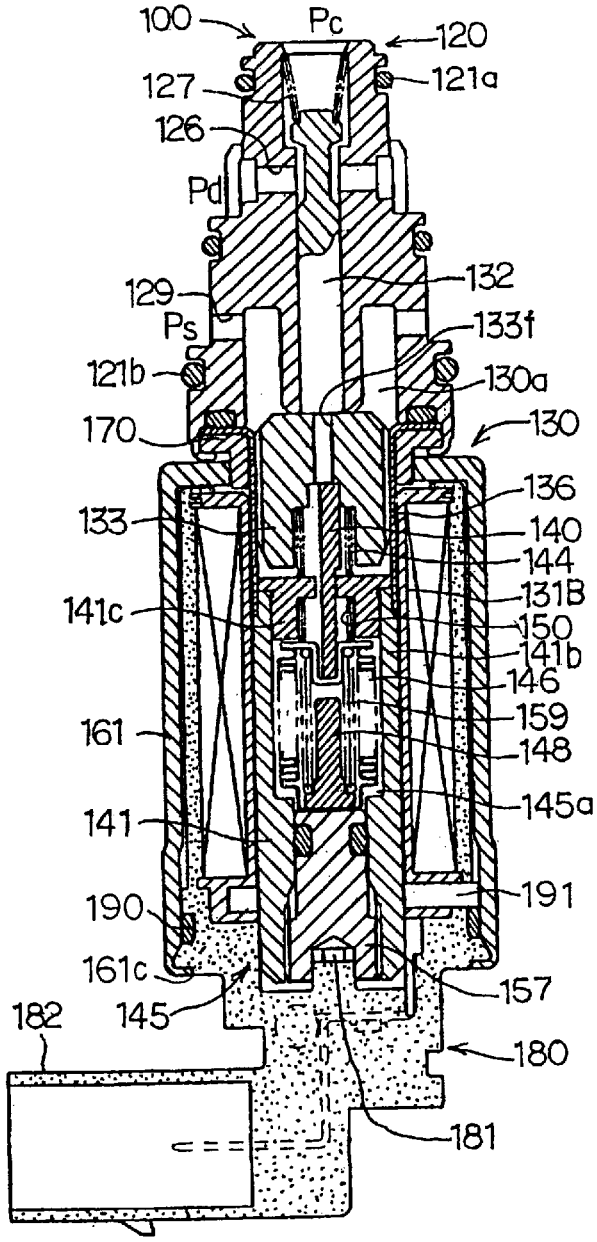
FIG. 6A is a partial longitudinal sectional view of a control valve in the first embodiment of the invention and FIG. 6B is a partial detailed view of the control valve of FIG. 6A.

As shown in FIG. 6A, a pressure-sensitive part 145 of a control valve 100 has an adjusting screw 157, which is provided so as to permit an adjustment of forward and backward movement with respect to a frame supporting the pressure-sensitive part 145, i.e., an attraction element 141, and sensitivity can be adjusted by expanding and contracting a pressure-sensitive element, i.e., a bellows 146 by means of this adjusting screw 157. Furthermore, the adjusting screw 157 engages against an engagement part 181 annexed to a coil assembly 180 which constituting a solenoid excitation part 130. In addition, in FIG. 6A, a mark 191 is an iron plate which constitutes a magnetic circuit. Reference numeral 191 denotes iron plate constituting a magnetic circuit.

In the above-described features, the control valve 100 is configured in such a manner that by rotating the coil assembly 180 with respect to the attraction element 141, the adjusting screw 157 is rotated and the bellows 146 is expanded and contracted. Incidentally, a connector 182 is formed (molded) integrally with the coil assembly 180 by use of a synthetic resin.

Figure 6B:
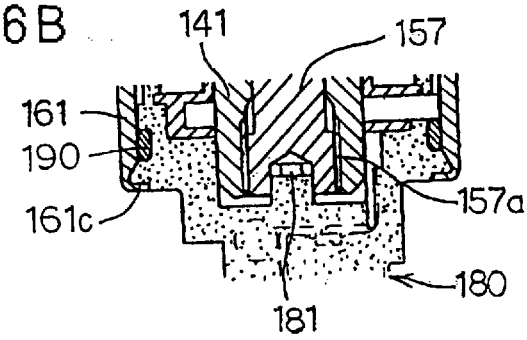
Figure 7A:
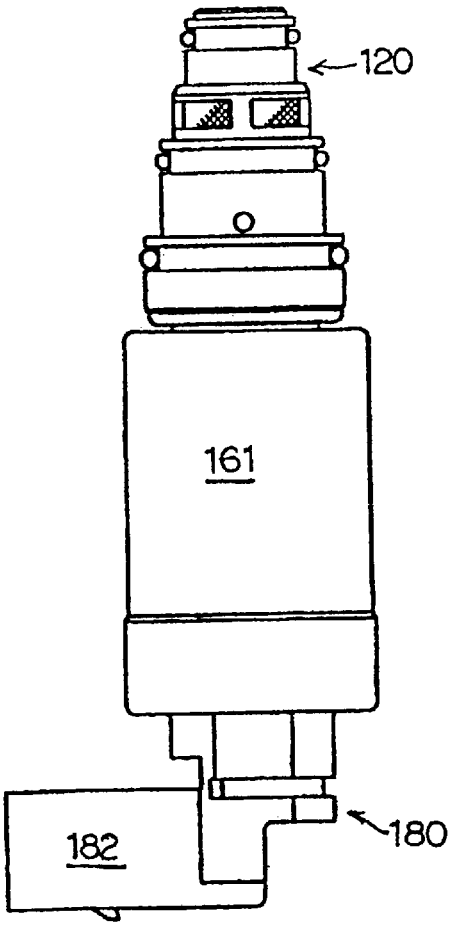
FIGS. 7A, 7B and 7C are a front view, a side view and a bottom view, respectively, of the control valve shown in FIG. 6A.
Figure 7B:
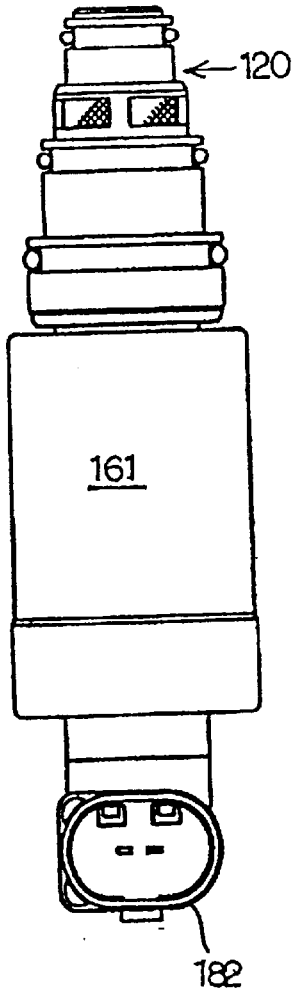
Figure 7C:
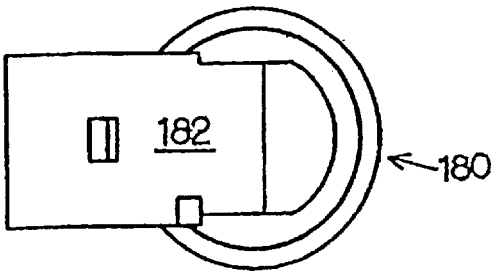

As shown in FIGS. 6A and 6B, the O-ring 190 is mounted in the coil assembly before or after rotation of the coil assembly 180 for adjustment of the adjusting screw 157.

And, finally, the coil assembly 180 is fixed to the solenoid housing 161 by caulking (see reference numeral 161C).

Furthermore, because the coil assembly 180 and connector 182, along with a solenoid housing 161, seal the solenoid excitation part, the control valve 100 of this embodiment is desirable also from the standpoint of the sealing capacity such as waterproof property and airtightness of the solenoid excitation part.

Incidentally, this embodiment can be applied to other pressure-sensitive elements in which no bellows is used. Furthermore, it is needless to say that this embodiment can be applied to another frame in which the frame which supports the pressure-sensitive part 145 is not the attraction element 141.

Next, the control valve of the second embodiment of the invention will be described by referring to FIGS. 8A and 8B. Incidentally, the same reference numerals shown in FIGS. 8A and 8B as those shown in FIG. 5 denote the same members.

In a control valve 100 of this embodiment, a pressure-sensitive part 145 has an adjusting screw 157, which is provided so as to permit an adjustment of forward and backward movement with respect to a frame supporting the pressure-sensitive part 145, i.e., an attraction element 141, and sensitivity can be adjusted by expanding and contracting a pressure-sensitive element, i.e., a bellows 146 by means of this adjusting screw 157. Furthermore, the adjusting screw 157 engages against an engagement part 181 annexed to a coil assembly 180 which constituting a solenoid excitation part 130.

Furthermore, a solenoid housing 161 is provided at an outer periphery of the solenoid excitation part 130 and supports the coil assembly 180 through an O-ring 190 disposed in an engagement shoulder portion 181*a* of the coil assembly 180. For this purpose, a ring-mounting recess 183 with a notched section is formed in an outer periphery of the above-described coil assembly 180. Furthermore, the solenoid housing 161 opposed to this ring-mounting recess 183 is provided with a lid part 161*c* which is formed in an end of the solenoid housing through a bending part 161*b*. Reference numeral 191 denotes iron plate constituting a magnetic circuit.

In the above-described features, the control valve 100 is configured in such a manner that by rotating the coil assembly 180 with respect to the attraction element 141, the adjusting screw 157 is rotated and the bellows 146 is expanded and contracted. And after the bellows 146 is set at an appropriate length, the O-ring 190 is disposed in the ring-mounting recess 183. Incidentally, the coil assembly 180 may be rotated with respect to the attraction element 141 after the O-ring 190 is disposed in the ring-mounting recess 183.

Figures 8A, 8B:
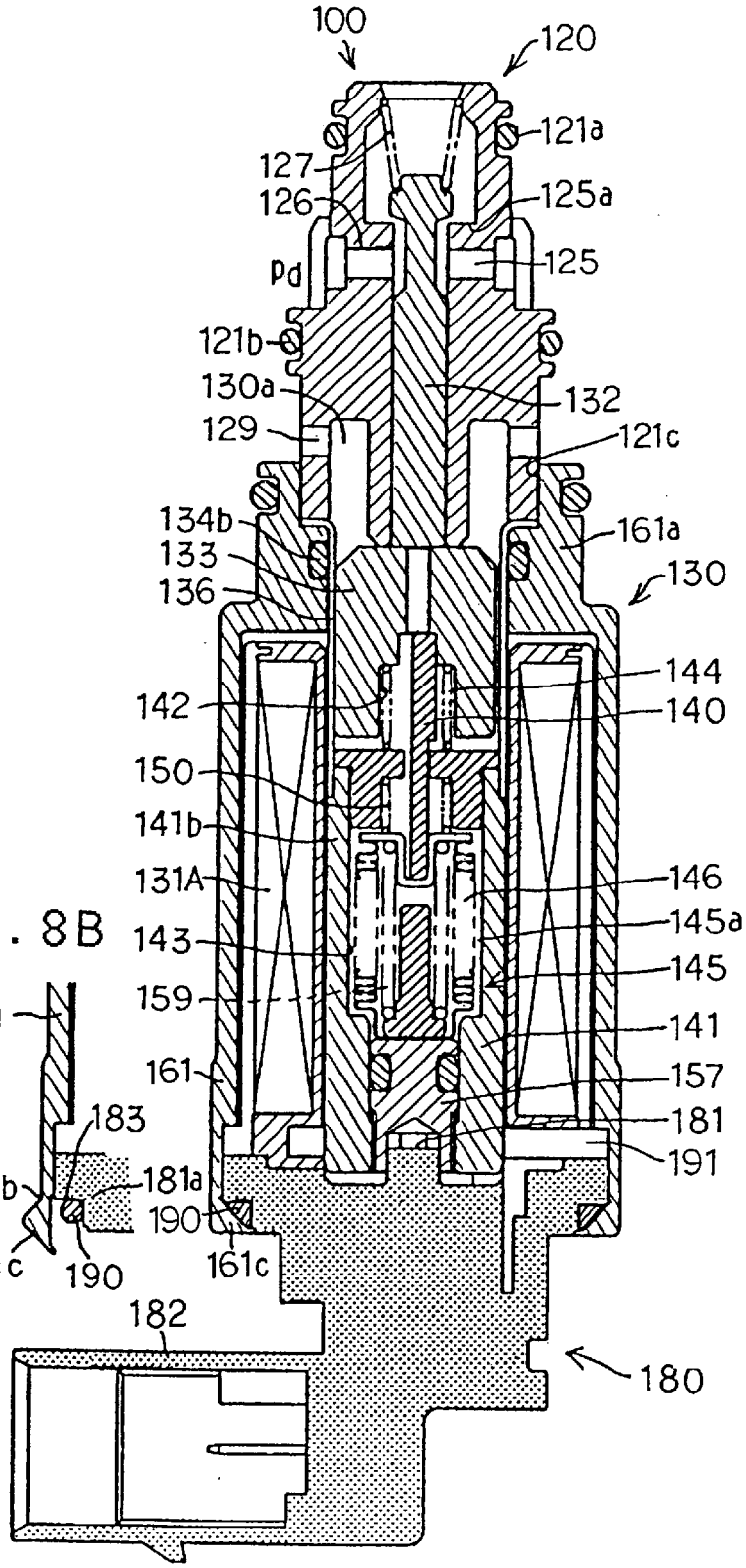
FIG. 8A is a partial longitudinal sectional view of a control valve in the second embodiment of the invention and FIG. 8B is a partial detailed view of the control valve of FIG. 8A.

In any case, in the above-described features, in order to fix the solenoid housing 161 to the coil assembly 180 after disposing the O-ring 190 in the ring-mounting recess 183, it is necessary only that the lid part 161*c* be bent (caulked) through the bending part 161*b*, bringing the lid part 161*c* from the condition shown in FIG. 8B to the condition shown in FIG. 8A. Therefore, because during the rotation and adjustment of the solenoid housing 161, the O-ring 190 is in a condition free from abutment and contact with the solenoid housing 161, the coil assembly 180 can rotate easily. Furthermore, because the O-ring 190 is not subjected to an external force, deformation such as catching does not occur and hence the seal function does not deteriorate. Incidentally, the connector 182 is integrally formed (molded) with the coil assembly 180 by use of a synthetic resin.

Figure 9A:
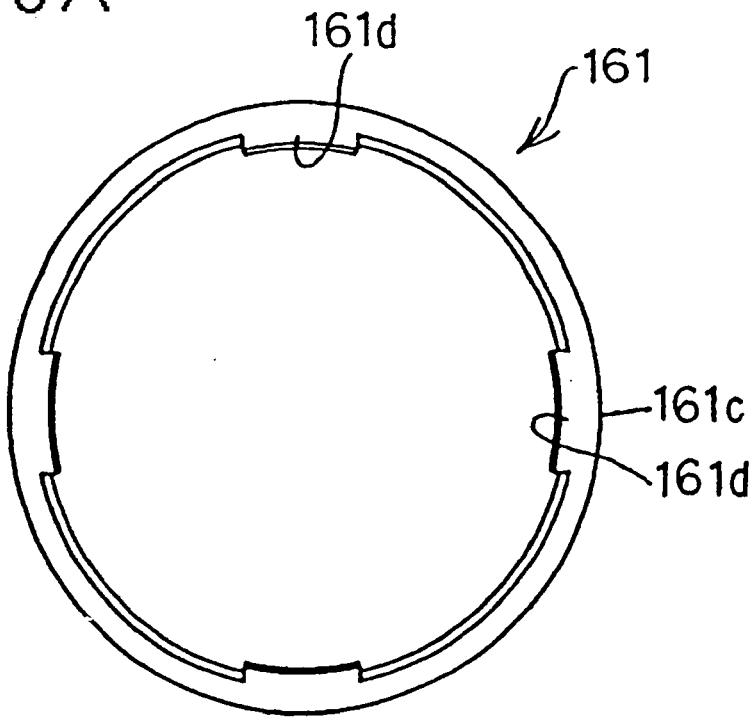
FIGS. 9A and 9B are a partial plan view and a sectional view, respectively, in an example of modification of the control valve shown in FIG. 8A.
Figure 9B:
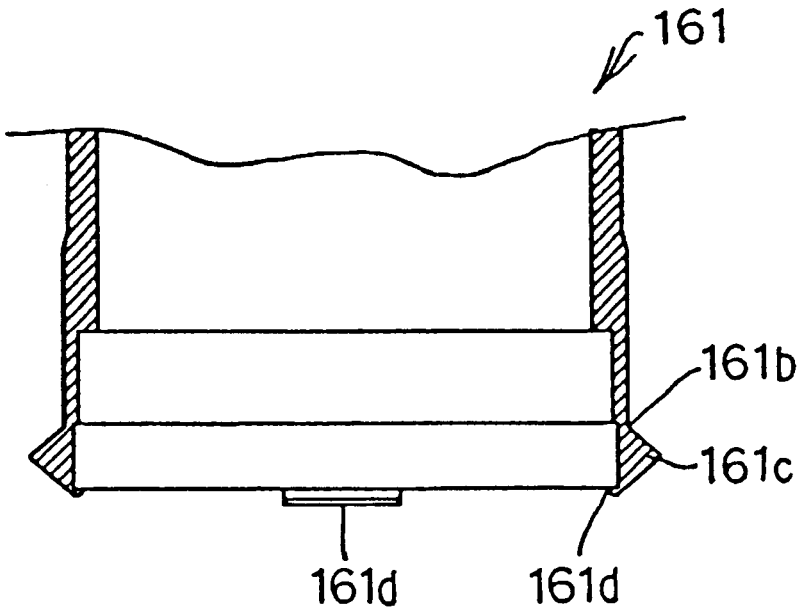

Incidentally, in order to ensure that the coil assembly 180 is forcedly fixed to the solenoid housing 161 thereby to prevent the rotation of the coil assembly 180, it is preferred that a plurality of, for example, four projections 161*d* digging into the coil assembly 180 be formed at equal intervals in an edge portion of the lid part 161*c* so that the plurality of projections 161*d* engage with the coil assembly 180 in a dug-in condition, as shown in FIGS. 9A and 9B.

Especially because the coil assembly 180 and connector 182, along with the solenoid housing 161, seal the solenoid excitation part, the control valve 100 of the second embodiment of the invention is desirable also from the standpoint of the sealing capacity such as waterproof property and airtightness of the solenoid excitation part.

Furthermore, unlike the above-described control valve shown in FIG. 5, the control valve body 120 of the control valve 100 and the solenoid excitation part 130 in this embodiment are configured in such a manner that the control valve body 120 is integrally formed with the solenoid excitation part 130 by being screwed from above into a large-thickness portion 161*a* formed in the upper part of the solenoid housing 161 (see a screwing part 121*c*).

Therefore, the number of parts of the whole control valve decreases, ensuring positive and simple mounting of the control valve body 120 on the solenoid excitation part 130. In addition, because the shape of the adjusting screw is changed and an assembling direction from above is adopted, the assembling efficiency can be improved. Also, there is an advantage that magnetic leakage can be reduced.

Furthermore, because the packing 134*b* is positioned outside a pipe 136 in the control valve of this embodiment, assemblability can be improved.

Incidentally, the control valve of this embodiment can also be applied to a case where a bellows is not used as the pressure-sensitive element. Furthermore, it is needless to say that the control valve of this embodiment can also be applied to a case where the frame supporting the pressure-sensitive part 145 is a frame other than the attraction element 141.

What is claimed is:

1. A control valve for variable-capacity compressor comprising a control valve body, a solenoid excitation part, and a bellows as a pressure-sensitive element; wherein the sensitivity of said bellows is adjusted by an adjusting screw provided so as to permit an adjustment of forward and backward movement with respect to an attraction element that supports said pressure-sensitive element, and the adjusting screw is rotationally operated by engaging an engagement part annexed to a coil assembly constituting said solenoid excitation part against said adjusting screw thereby to operate the coil assembly.

2. The control valve for variable-capacity compressor according to claim 1, wherein a connector of the solenoid excitation part is formed integrally with said coil assembly by use of a synthetic resin.

3. The control valve for variable-capacity compressor according to claim 2, wherein the bellows is expanded and contracted by rotating the coil assembly or connector with respect to said attraction element.

4. The control valve for variable-capacity compressor according to claim 1, wherein a solenoid housing is provided at an outer periphery of said solenoid excitation part, and, for mounting said coil assembly on said solenoid housing through an O-ring, a ring-mounting recess with a notched section is formed in an outer periphery of said coil assembly and the solenoid housing opposed to said ring-mounting recess is provided with a lid part formed in an end of the solenoid housing through a bending part.

5. The control valve for variable-capacity compressor according to claim 4, wherein the bellows is expanded and contracted by rotating the coil assembly or connector with respect to said attraction element.

6. The control valve for variable-capacity compressor according to claim 4, wherein a plurality of projections digging into the coil assembly are formed in an edge portion of said lid part.

7. The control valve for variable-capacity compressor according to claim 4, wherein the frame supporting said pressure-sensitive part is constituted by an attraction element, and the bellows is expanded and contracted by means of an adjusting screw provided so as to permit an adjustment of forward and backward movement with respect to this attraction element.

* * * * *